United States Patent [19]

Chapel, Jr. et al.

[11] Patent Number: 4,803,457

[45] Date of Patent: Feb. 7, 1989

[54] COMPOUND RESISTOR AND MANUFACTURING METHOD THEREFORE

[76] Inventors: Roy W. Chapel, Jr., 23417 93rd Ave. W., Edmonds, Wash. 98020; David N. Duperon, 9911 84th St. NE., Lake Stevens, Wash. 98258; Joseph E. Meadows, 4841 268th Ave. NE., Redmond, Wash. 98053

[21] Appl. No.: 19,669

[22] Filed: Feb. 27, 1987

[51] Int. Cl.[4] ..... H01C 10/00

[52] U.S. Cl. ..... 338/195; 338/308; 338/25

[58] Field of Search ..... 338/195, 3, 9, 13, 25, 338/308, 309

[56] References Cited

U.S. PATENT DOCUMENTS

| | | | |
|---|---|---|---|
| 4,041,440 | 8/1977 | Davis et al. | 338/195 |
| 4,079,349 | 3/1978 | Dorfield | 338/9 |
| 4,375,056 | 2/1983 | Baxter et al. | 338/195 X |
| 4,464,646 | 8/1984 | Burger et al. | 338/25 |
| 4,582,976 | 4/1986 | Merrick | 338/195 X |

*Primary Examiner*—C. L. Albritton

[57] ABSTRACT

A compound resistor is formed of a resistive material making up a predominant portion of the resistance and having a small negative TCR coupled with an adjustment material having an extremely low resistance and a very high positive temperature coefficient of resistance. After the manufacturing process, a portion of the adjustment material is removed to adjust the composite TCR of the compound resistor substantially to zero without significantly affecting the resistance.

13 Claims, 1 Drawing Sheet

COMPOUND RESISTOR AND MANUFACTURING METHOD THEREFORE

TECHNICAL FIELD

The present invention relates to minimization of the temperature induced variation of resistance in the resistors, and more particularly to a thin film resistor having an adjustment portion made of a material having a temperature variation characteristic substantially greater than and in an opposite direction from the characteristics of the resistive portion.

BACKGROUND OF THE INVENTION

It has long been known that the resistance of resistive materials used in resistors changes with temperature. This characteristic has been denoted as the "temperature coefficient of resistance" (TCR) and is measured by determining the actual resistance change for each degree of temperature change. The TCR is typically given in parts per million variation per degree centigrade, or ppm/°C.

To assure predictability of operation of electronic devices using resistors, and to increase the precision and reliability of such devices, there have been many attempts to reduce the TCR of resistors towards "absolute zero". There is currently no method of achieving this absolute zero. Currently, the TCR is considered to be substantially zero when it is within the range of plus or minus 0.5 ppm/°C.

In the past, precision wirewound resistors have been made by a costly process selecting equal value resistors and selectively matching negative and positive TCR's (which result from manufacturing variations) from a large collection of resistors. While initial TCR's could be controlled closely, long term resistance drift occured which was unique for each resistor and which resulted in the overall resistance drifting with time. Further, due to the bulk of the individual resistors, close thermal couling was and is not possible so the apparent ratio TCR (to be hereinafter defined) also changed with temperature gradients present.

In the past also, a typical approach for thin film resistors has been to find low TCR materials. A resistor of this type is shown in the Burger et al., Patent, U.S. Pat. No. 4,464,646. The resistor is made of tantalum, tantalum nitride, or tantalum oxintride and is described as having "essentially" zero TCR. In fact, these materials have TCR's which range from plus or minus 100 ppm/°C. which are many orders of magnitude from absolute zero or even substantially zero.

While Burger teaches a thin film circuit for controlling the temperature coefficient of resistance, it is directed towards providing a resistor which will be temperature dependent so it can act as a temperature sensor or a compensator for other elements. It does not teach or suggest a compound resistor having even substantially zero TCR since it presupposes that materials exist capable of providing such a TCR for the applications in which the Burger invention is used. For example, Burger specifies essentially zero TCR Tantalum which actually has a TCR of 80 ppm/°C. plus or minus 10%.

Other attempts have been made to control TCR by the amount of material contained in a resistor as shown in the Baxter Patent, U.S. Pat. No. 4,375,056, or by control of the configuration of the resistor as shown in the Dorfield Patent, U.S. Pat. No. 4,079,349. However, the TCR's using these methods are still several orders of magnitude away from absolute zero or even substantially zero.

A further method of control is by the manipulation of the processing of the resistor materials, the annealing of the materials with temperature, or otherwise controlling the manufacture of the material and its deposition on substrates (in the case of thin film resistors) while forming the resistor. However, such process variations are complex, expensive, and cannot predictively and repeatably achieve the desired results. Thus, any given resistor manfactured by using materials so fabricated may still suffer various temperature deficiencies which cannot thereafter be corrected. Therefore, there has been a long term need for a resistor which has absolute zero TCR or which can be adjusted to have a substantially zero TCR after its fabrication has been completed.

When considering groups of resistors, which are called resistor arrays, there has been a long felt need for a resistor in which the TCR can be adjusted after fabrication to match or compensate for the TCR in other resistors of the array.

In some resistor arrays, it is not essential that all the resistors have a absolute or substantially zero TCR. It is more important that as temperature changes, the TCR's track each other or change resistances in parallel with changes in temperature. This important characteristic is called ratio TCR and is often expressed as the difference in the TCR's of various resistors in the resistor array. Since it is a difference of TCR's, it is also measured in ppm/°C.

In the prior art, there's been a long felt need to minimize the ratio TCR in resistor arrays, and particularly to minimize the ratio TCR to zero or substantially zero for precision devices which is below 0.5 ppm/°C.

In the past, very high precision resistors were generally hermetically sealed to reduce shifting in TCR values or resistances due to humidity or other environmental effects. This hermetic sealing made it impossible to change either the TCR or the resistance after the resistor array was completely fabricated. In essence, any final "adjustment" to refine any value was not physically possible.

SUMMARY

The present invention provides a method for manufacturing a compound resistor which can be configured to a TCR which is substantially zero, as can be currently measured with production manfacturing instrumentation. The present invention additionally provides a method for manufacturing a compound resistor which can be configured to a TCR which is absolute zero.

The present invention also provides a method of manufacturing a compound resistor with a TCR which may be adjusted after fabrication.

The present invention further provides a method for manufacturing a compound resistor, for use in a resistor array, which can be adjusted to control the ratio TCR of the resistor array.

The present invention still further provides a method for manufacturing a compound resistor having a predetermined resistance value and an absolute or substantially zero TCR.

The present invention still further provides a method for manfacturing a compound thin film resistor, for use in a resistor array, which can be adjusted, or trimmed, after fabrication to control the ratio TCR of the resistor array.

The present invention further provides a compound resistor, for use in a resistor array, which can provide an absolute or substantially zero ratio TCR for the resistor array.

The invention more specifically provides a compound resistor having a resistive portion and an adjustment portion. The resistive portion is formed of a material having a high resistivity and a low TCR; and the adjustment portion is formed of a material having a lower resistivity and a higher TCR of opposite value to the TCR of the resistive material. After fabrication, the configuration of the adjustment portion is trimmed or configured by a laser machining process to increase the overall resistance of the compound resistor by a negligible amount and to substantially or totally cancel out the TCR's.

The invention further specifically provides a compound resistor for use in a resistor array where the adjustment portion is trimmed or configured by laser machining to cause the ratio TCR of the resistor array to be absolutely or substantially zero.

The above additional advantages of the present invention will become apparent to those skilled in the art from a reading of the following detailed description when taken in conjunction with the accompanied drawings.

DESCRIPTION OF THE PREFERRED EMBODIMENT

Figure 1:
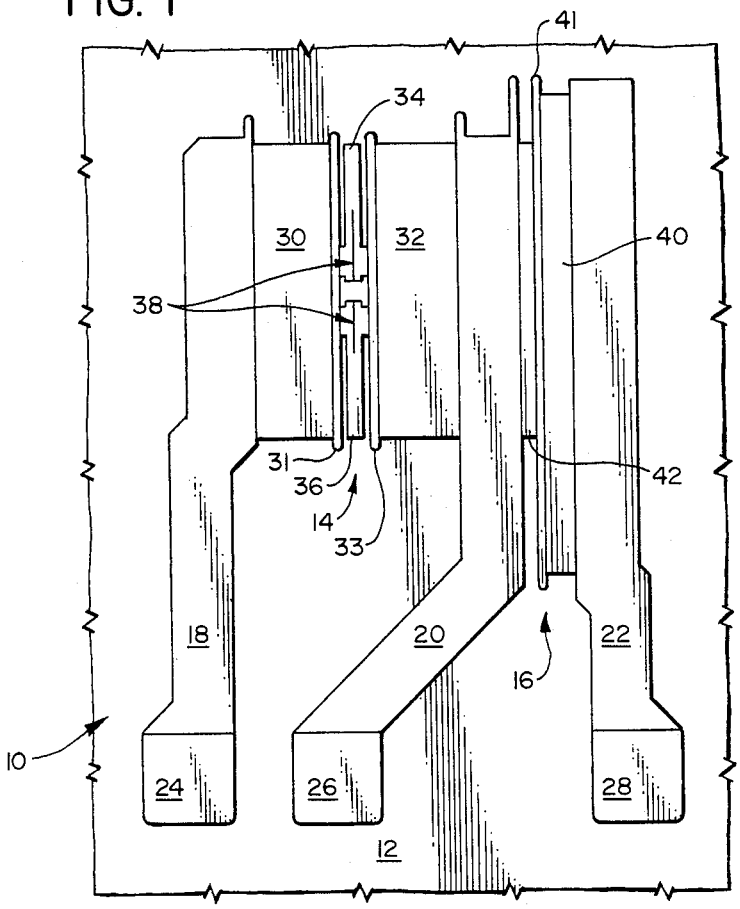
FIG. 1 shows a compound resistor fabricated in accordance with the present invention.

Referring now to FIG. 1, therein is shown a resistor array 10 mounted on a substrate 12. The substrate 12 could be glass or some other material, but is by preference alumina ($Al_2O_3$). The resistor array 10 contains two compound resistors 14 and 16. Inputs and outputs to the compound resistors 14 and 16 are via leads 18, 20, and 22 which terminate at their far ends in tabs, respectively 24, 26, and 28.

The compound resistor 14 is made up of two resistive portions 30 and 32 connected by leads 31 and 33, respectively, to adjustment portions 34 and 36. The adjustment portion 34 and 36 are configured, as hereinafter described, by a machined kerf 38, which in the preferred embodiment is produced by a laser.

The compound resistor 16 which lies between leads 20 and 22 consists of a resistive portion 40 connected by a lead 41 to an adjustment portion 42. In FIG. 1, the adjustment portion 42 is shown without a lasered in kerf.

While the compound resistors 14 and 16 are shown as being interconnected, this is not necessarily true in all resistor arrays. Some resistor arrays are comprised of large numbers of independent resistors on the same substrate.

Figure 2:
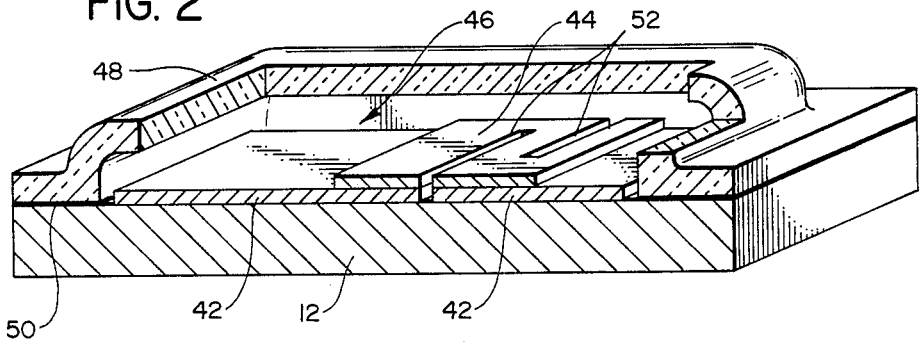
FIG. 2 shows a cutaway expanded isometric of a portion of a thin film resistor in accordance with the present invention.

Referring now to FIG. 2, therein is shown a portion of thin film compound resistor fabricated in accordance with the preferred embodiment of the invention. As known to those skilled in the art, thin film resistors area manfactured by the process of depositing the resistive material on to a substrate and then removing the undesired resistive material by conventional photolithographic processes.

In the present invention, a resistive material 42 is first deposited on the substrate 12. Adjustment material 44 is then deposited on top of the resistive material 42. This process results in the resistive material 42 continuously underlaying the adjustment material 44. It should be noted, however, the order of deposition is not critical nor the number of layers above, below, or between the resistive and adjustment materials as long as the materials are conductively connected to provide a compound resistor having a single, composite TCR.

After the depositions, which may be by vacuum, chemical, or other deposition processes, the adjustment material 44 is photosensitized and then etched away to leave areas of the resistive material exposed. Subsequently, the resistive material 42 is removed to leave the desired configuration of resistive material 42 on the substrate 12.

This combination of resisitive material 42 and adjustment material 44 form the compound resistor 46. Once the proper overall configuration of the compound resistor 46 is complete and the various leads and tabs (not shown) are completed a laser transparent cover 48 is disposed over the compound resistor 46 and bonded to the substrate 12 with a hermetic sealant 50. Any required external leads or lead frames can be attached to the resistor tabs after hermetic sealing. The hermetic sealing generally prevents any changes in any of the resistances due to environmental effects caused by moisture of airborne particles.

While it is possible to change the overall configuration of the resistors prior to hermetic sealing by such techniques as an abrasive trimming, high pressure waterjet trimming, etc., after hermetic sealing, only laser trimming or other non-intrusive trimming is possible. The laser passes through the laser transparent cover 48 and vaporizes kerfs 52 through the adjustment material 44 and the resistance material 42 down to the substrate 12 without affecting the hermetic seal. The vaporized material has no measurable effect on the hermetically sealed resistors.

In the manufacturing of the resistor array 10 in FIG. 1, the leads 18, 20, 22, 31, 33 and 41 are selected to be of a highly conductive material such as gold or silver. The resistive portions 30, 32 and 40 are selected to be of a high resistance material such as nickel chromium (nichrome), chromium silicide, tantalum, or tantalum nitride. These materials generally tend to be characterized by a TCR in the range between −50 and +50 ppm/°C. Nichrome in standard resistors ranges between −25 and +25 ppm/°C. In the preferred embodiment, the thin film resistors have a TCR ranging between 0 and −30 ppm/°C. It should be noted, although TCR is generally nonlinear over a wide temperature range, it may be considered to have a single value over the usual temperature ranges to which precision electronic devices are subject.

The adjustment portions 34, 36 and 42 may be made from a number of low resistance materials such as nickel, gold, tungsten, or silver which are generally characterized by a positive TCR in the range of about +500 to +9000 ppm/°C. In the preferred embodiment, the adjustment portions 34, 36, and 42 are made of nickel having a TCR of approximately +5000 ppm/°C.

In selecting the amount of preliminary etching which will be necessary to provide a compound resistor having a predetermined nominal resistance, the resistive portions 30 and 32 are etched to have a resistance quite close to the desired nominal resistance of the compound resistor 14, and similarly, the resistive poriton 40 is etched to have a resistance close to the desired resistance of the compound resistor 16. Preferably, when looking at the compound resistor in its simplest form as shown as compound resistor 16, the total resistance value of the resistive portion 40 should be at least 50% of the ultimate, nominal resistance of the completely finished compound resistor 16 despite any process control problems.

Conversely, the preliminary etched adjustment portion 42 provided less than 0.5% of the desired predetermined nominal resistance.

In the preferred embodiment, the resistive material is further brought within 90% of the nominal value by laser machining after the photolighographic removal processes. This is referred to as the rough laser machining although the same laser may be used to obtain the final precise TCR and resistance values.

One aspect of the present invention is that the percentage of the desired nominal resistive value which should be attained by the resistive material may be expressed as $[100\ (\text{abs TCR}_a)/(\text{abs TCR}_a+\text{abs TCR}_r)]\%$ where abs $\text{TCR}_r$ is the absolute value of the temperature coefficient of resistance of the resistive material and abs $\text{TCR}_a$ is the absolute value of the temperature coefficient of resistance of the adjustment material. Similarly, the percentage of the predetermined nominal value for the adjustment material is $[100\ (\text{abs TCR}_r)/(\text{abs TCR}_a+\text{abs TCR}_r)]\%$.

When manufacturing a resistor such as compound resistor 16, the resistance and the TCR after initial photolithographic fabrication are measured. This measurement would indicate that the resistance is primarily from the nichrome in the resistive portion 40 and the TCR is not yet zero from the nickel in the adjustment portion 42. If the resistance is not primarily from the nichrome and close to 90% of final value, further rough laser machining is performed until it is. While it is possible taht the TCR may be zero after photolithographic fabrication, it is highly improbable.

Assuming, as would probably be the case, that the TCR is not substantially zero, the magnitude of the TCR would have to be reduced. This can be accomplished by changing the geometric configuration of the adjustment portion. Looking at the compound resistor 14 in FIG. 1, it may be seen that by lengthening the kerfs 38, that the resistance of the adjustment portions 34 and 36 will be increased. Similarly, as the resistance is increased, the TCR contribution of these portions is increased.

With regard to the resistance, the change of configuration to the adjustment portions 34 and 36 can cause the resistance thereof to increase by a factor of 100. However, it will be evident that the absolute value of resistance contributed by the adjustment portions 34 and 36 will remain relatively small compared to the overall resistance of the compound resistor 14 since the adjustment portions 34 and 36 have extremely low resistances to begin with.

However, as the resistances of the adjustment portions 34 and 36 increase, there is a considerable change in the contribution of the TCR of the adjustment portions 34 and 36 to the TCR of the compound resistor 14. This should bring the TCR of the compound resistor 14 from −30 ppm/°C. to approximately 0 to −3 ppm/°C.

As would be evident to those skilled in the art, the compound resistor 14 would have a very slightly increased resistance, but a TCR which would be close to zero.

A second measurement at this point would indicate that further laser machining of the adjustment portions 34 or 36 may be required to further decrease the TCR to obtain the precision instruments "substantially zero" of within plus or minus 0.5 ppm/°C. or that the TCR is too greatly negative or too far positive.

As would be evident to those skilled in the art, the measurements and laser machining could all be carried out under the guidance of a computer so that substantially zero TCR compound resistors can be quickly and inexpensively manfactured. Since the machining accuracy of laser technology is many times greater than the resolution ability of even the best laboratory instrumentation to measure TCR and it is possible that the machining accuracy will continue to increase, it would be obvious to those skilled in the art that the method of the present invention can be used to provide compound resistors and resistor arrays having absolute zero TCR's, absolute zero ratio TCR's, and exact resistance values.

As an illustrative example of a heretofore unavailable compound resistor, a structure such as shown in FIG. 1 was used to fabricate a resistor having a nominal resistance of 100 ohms. The adjustment portions 34 and 36 were formed of nickel having a resistivity of approximately 0.1 ohm per square. The resistive portions 30 and 32 were formed of nichrome having a resistivity of slightly under 100 ohms per square. The TCR of the nickel as previously mentioned is approximately +5000 ppm/°C. and the TCR of nichrome is between −30 ppm/°C. and 0 ppm/°C.

The dimensions of the adjustment portions 34 and 36 were selected to have a resistance of 0.05 ohms before precision laser machining. The resistive portions 30 and 32 were configured to provide 80 ohms of resistance by having 0.75 square of nichrome. Finally, the resistivity of the gold used to cover the leads is 6.0 milliohms per square. With approximately 12 squares of gold used, the contribution of the gold to the total resistance is approximately 70.0 milliohms.

In accordance with the method of the present invention, the adjustment portions 34 and 36 were trimmed to change their configuration and to increase the number of squares from 0.5 to approximately 6.0, or a change of approximately 12 to 1 in the contribution of the nickel to the composite resistance. The contribution of the adjustment portions 34 and 36 to the composite resistance is changed as a result from approximately 0.05 ohms to 0.6 ohms, still a very small portion of the composite resistance of 100 ohms. However, the increase in the resistance contribution is accompanied by a substantial increase in the contribution of the adjustment portions 34 and 36 to the TCR of the composite TCR. The laser machining essentially brough the composite TCR up from −30 ppm/°C. to −3 ppm/°C.

Although such composite TCR was much closer to absolute zero TCR than had previously been possible with production equipment, a further step was performed in which the laser machining step was repeated on the adjustment portions 34 and 36 in order to improve the TCR still further. After second precision laser machining trim, repeated tests of the compund resistor gave composite TCR values within plus or minus 0.5 ppm/°C. The exact TCR could not be determined because it was closer to absolute zero than the capability of the production instrumentation used to measure TCR values.

As long as additional resistance can be added without exceeding the predetermined nominal resistance, and if additional modification of the TCR is desirable, further laser machine trim steps may be performed.

As known to those skilled in the art, it is often more important that all the resistors in a resistor array change by the same percentage over a given temperature range than it is for particular resistors to have zero TCR. This characteristic of the resistors having parallel TCR's has a number of different names in the industry. The most common name is ratio TCR, but it is also known as TCR tracking and TCR ratio. Ratio TCR may be mathematically described as the difference between the TCR's of the various resistors. So it is expressed as ppm/°C. which are the same units as for TCR.

In the resistor array 10, the ratio TCR of the compound resistors 14 and 16 may be adjusted to substantially zero, i.e. to track within 0.5 ppm/°C., or to absolute zero by controlling the configuration of the adjustment portions 34 and 36 of the compound resistor 14. Essentially, the TCR of the compound resistor 14 is set to match the TCR of the compound resistor 16 even though the TCR of the compound resistor 16 can vary over the range of −100 ppm/°C. to +100 ppm/°C. As long as the compound resistor 14 has a TCR equal to or less that the TCR of the resistor which is to be matched such as compound resistor 16 by 50 ppm/°C. (i.,e. $(TCR_1-50)$ppm/°C. where $TCR_1$ k is the TCR to be matched) prior to adjustment, the TCR of the compound resistor 14 can be adjusted by configuration control of the adjustment portion 34 and 36 to match the TCR of the compound resistor 16 within 0.5 ppm/°C.

In another aspect of the present invention as it relates to resistor arrays, the percentage of the desired nominal resisitive value which should be attained by the resistive material of the compound resistor which is to be adjusted may be expressed as $[100\ (\text{abs}\ TCR_a)/(\text{abs}\ TCR_a + \text{abs}\ (TCR_r - TCR_1))]\%$ where abs $TCR_a$ is the absolute value of the temperature coefficient of resistance of the adjustment material of the compound resistor which is to be adjusted, abs $(TCR_r - TCR_1)$ is the absolute value of the quantity of the temperature coefficient of resistance of the resistance material of the compound resistor which is to be adjusted minus the temperature coefficient of resistance of the other resistor in the array which the compound resistor is to be matched against. Similarly, the percentage of the predetermined nominal value for the adjustment material is $[100\ (\text{abs}\ (TCR_r - TCR_1))/(\text{abs}\ TCR_a + \text{abs}\ (TCR_r - TCR_1))]\%$.

Similarly, the ratio TCR of a series of independent resistors on a substrate may be adjusted to substantially zero or absolute zero by the method of the present invention; i.e. one resistor of the array may be designed with a more positive TCR and all the remaining resistors adjusted positively to match the one resistor.

Although the present invention may be applied to thick, thin, bulk metal, and polymer film resistive devices, it is recognized that circumstances under which a user requires a substantially zero or absolute zero TCR or ratio TCR are those which appear only in the most accurate precision electronic device applications. Generally, thin film and bulk metal products tend to be more stable and more precise than thick film or polymer film, to have lower noise, etc. Thus, it is more likely that the inventive method and compound resistor will be used in thin film and bulk metal applications although, as materials for thick film and polymer films are improved, the method may find increasing applications in such resistor arrays.

In view of the principles and results disclosed herein, it is expected that the adjustment material will typically have a large TCR in an opposite direction from the TCR of the resistive material. Moreover, the resistivity of the adjusting material will typically be much lower than that of the resistive material to provide considerable latitude in the amount change in the geometrical configuration of the adjustment portion so as to have minimal effect on the composite resistance but a substantial effect on the composite TCR. However, the present invention contemplates the laser trimming of leads and tabs if required to attain the desired TCR and resistance values.

It should further be noted that hermetic sealing of resistor arrays provides an extremely stable resistor package and the laser machining trim after manfacture also provides an extremely accurate resistor array with controlled temperature characteristics.

The foregoing description of the preferred embodiment of the present invention has been presented for purposes of illustration and description, and is not intended to be exhaustive or to limit the invention to the precise forms disclosed. Many modifications and variations are possible in light of the above teaching. The embodiment was chosen and described in order to best explain the principles of the invention and its practical application, thereby to enable other skilled in the art to best utilize the invention in various embodiments and with various modifications as are suited to the particular use contemplated therefore. It is to be understood that all matters set forth herein are shown in the accompanied drawings to be interpreted in an illustrative and not a limiting sense.

We claim:

1. A compound resistor comprising:

a first portion having a first resistance and a first temperature coefficient of resistance; and a second portion connected to said first portion having a second resistance and a second temperature coefficient of resistance, said first resistance different in magnitude from said second resistance and said second temperature coefficient of resistance different in magnitude from and opposite in direction from said first temperature coefficient of resistance, at least one of said first and second portions configured to have a temperature coefficient of resistance which substantially cancels out the temperature coefficient of resistance of the other said first and second portions to provide a substantially zero composite temperature coefficient of resistance for said compound resistor.

2. In a resistive system with a first resistor having a predetermined resistance and a predetermined temperature coefficient of resistance, a compound resistor comprising:

a first portion having a first resistance and a first temperature coefficient of resistance; and a second portion having a second resistance and a second temperature coefficient of resistance, said first resistance substantially larger in magnitude than said second resistance and said second temperature coefficient of resistance substantially larger in magnitude and opposite in direction from said first temperature coefficient of resistance, at least one of said portions configured to have the temperature coefficient of resistance of said compound resistor correspond to the predetermined temperature coefficient of resistance of said first resistor so as to provide a substantially zero ratio temperature coefficient of resistance between said first and compound resistors.

3. The compound resistor as claimed in claim 1 or 2, wherein said first portion has a positive temperature coefficient of resistance and said second portion has a negative temperature coefficient of resistance.

4. The compound resistor as claimed in claim 1 or 2, including:

means for hermetically sealing said first and second portions; and wherein said second portion includes means for adjusting the temperature coefficient of resistance of said first and second portions without affecting the hermetic sealing.

5. A compound resistor having a predetermined resistance value, comprising:

a first portion having a resistance at least 50% of said predetermined resistance value and a temperature coefficient of resistance in the range of minus 50 ppm/°C. to 0 ppm/°C.; and a second portion connected to said first portion having a resistance in the range of 0 to 10% of said predetermined resistance value and a temperature coefficient of resistance in the range of +500 ppm/°C. to +9000 ppm/°C. configured to provide a composite temperature coefficient of resistance in the range of −0.5 ppm/°C. to +0.5 ppm/°C. for said compound resitor.

6. The compound resistor as claimed in claim 5 wherein said second portion is configured to porvide a composite temperature coefficient of resistance of zero.

7. In a resistor array with a first resistor having a predetermined temperature coefficient of resistance, compound resistor having a predetermined resistance value comprising:

a first portion with a resistance at least 50% of said predetermined resistance value and a temperature coefficient of resistance in the range of minus 50 ppm/°C. to 0 ppm/°C.; and a second portion with a resistance in the range of 0 to 10% of said predetermined resistance value and a temperature coefficient of resistance in the range of +500 ppm/°C. to +9000 ppm/°C. configured to have a temperature coefficient of resistance of said compound resistor match the predetermined temperature coefficient of resistance of said first resistor to provide a ±0.5 ppm/°C. ratio temperature coefficient of resistance between said first and compound resistors.

8. The compound resistor as claimed in claim 7 wherein said second portion is configured to provide a composite temperature coefficient of resistance of zero.

9. The compound resistor as claimed in claim 5 or 7, including:

a substrate having a first and second portion as disposed thereon;

a laser light transparent cover disposed over said portions hermetically sealing said portions between said cover and said substrate; and wherein said second portion includes an adjustment area which is laser machinable through said cover to remove areas of said second portion to change the resistance and the temperature coefficient of resistance of said compound resistor.

10. A thin film compound resistor having a predetermined resistance value, comprising:

a thin flim resistance portion having a resistance of [100 (as $TCR_a$)/(abs $TCR_a$ +abs $TCR_r$)]% of said predetermined resistance value and a temperature coefficient of resistance in the range of −50 ppm/°C. to 0 ppm/°C.; and a thin film adjustment portion connected to said resistance portion having a resistance of [100 (abs $TCR_r$)/(abs $TCR_a$ +abs $TCR_r$)]% of said predetermined resistance value and a temperature coefficient of resistance in the range of +500 ppm/°C. to +9000 ppm/°C. configured to provide a composite temperature coefficient of resistance of said first and second portions in the range of −0.5 ppm/°C. to +0.5 ppm/°C. wherein abs $TCR_a$ is the absolute temperature coefficient of resistance of said adjustment portion and abs $TCR_r$ is the absolute temperature coefficient of resistance of said resistance portion.

11. The thin film compound resistor as claimed in claim 10 wherein said thin film adjustment portion is configured to provide a composite temperature coefficient of resistance of absolute zero.

12. In a resistor array with a first resistor having a predetermined fist resistance and a predetermined temperature coefficient of resistance, a compound resistor having a second predetermined resistance comprising:

a resistance portion with a resistance of [100 (abs $TCR_a$)/(abs $TCR_a$ +abs ($TCR_r$−$TCR_1$))]% of said second predetermined resistance value and a temperature coefficient of resistance in the range of ($TCR_1$−50)ppm/°C. to $TCR_1$; and an adjustment portion with a resistance of [100 (abs ($TCR_r$−$TCR_1$))/(abs $TCR_a$+abs $TCR_r$−$TCR_1$))]% of said second predetermined resistance value and a temperature coefficient of resistance in the range of +500 ppm/°C. to +9000 ppm/°C. configured to have the temperature coefficient of resistance of said compound resistor match the predetermined temperature coefficient of resistance of said first resistor to provide a no more than 0.5 ppm/°C. ratio temperature coefficient of resistance between said first and compound resistors wherein abs ($TCR_r$−$TCR_1$) is the absolute value of the quantity of the temperature coefficient of resistance of said resistive portion minus the temperature coefficient of resistance of said first resistor and abs $TCR_a$ is the absolute value of the temperature coefficients of resistance of said adjustment portion.

13. The compound resistor as claimed in claim 12 wherein said adjustment portion is configured to provide an absolute zero ratio temperature coefficient of resistance between said first and compound resistors.

* * * * *